US012673753B2

(12) United States Patent
Matsumura

(10) Patent No.: US 12,673,753 B2
(45) Date of Patent: Jul. 7, 2026

(54) ARTICLE HOLDING DEVICE AND PERSONAL WATERCRAFT

(71) Applicant: KAWASAKI MOTORS, LTD., Hyogo (JP)

(72) Inventor: Norikazu Matsumura, Akashi (JP)

(73) Assignee: KAWASAKI MOTORS, LTD., Akash (JP)

( * ) Notice: Subject to any disclaimer, the term of this patent is extended or adjusted under 35 U.S.C. 154(b) by 441 days.

(21) Appl. No.: 18/208,326

(22) Filed: Jun. 12, 2023

(65) Prior Publication Data

US 2024/0409191 A1 Dec. 12, 2024

(51) Int. Cl.
*B63B 34/10* (2020.01)

(52) U.S. Cl.
CPC ..... *B63B 34/10* (2020.02)

(58) Field of Classification Search
CPC ..... B63B 34/10
See application file for complete search history.

(56) References Cited

U.S. PATENT DOCUMENTS

| | | | | | |
|---|---|---|---|---|---|
| 778,381 | A * | 12/1904 | Sprague | A01K 97/10 | 248/514 |
| 3,564,753 | A * | 2/1971 | Fravel | A01K 97/10 | 248/538 |
| 4,908,973 | A * | 3/1990 | Perks | A01K 97/125 | 43/16 |
| 5,533,295 | A * | 7/1996 | Hochberger | A01K 97/10 | 248/512 |
| 6,840,190 | B2 * | 1/2005 | Godek | B63B 34/26 | 114/347 |
| 7,121,225 | B1 * | 10/2006 | Caples | B63B 19/14 | 114/347 |
| 10,577,057 | B1 * | 3/2020 | Hull | B63B 32/70 | |
| 11,399,527 | B2 * | 8/2022 | Erdmann | B60R 9/08 | |
| 2008/0276856 | A1 * | 11/2008 | Kreger | B63B 34/10 | 114/363 |
| 2013/0201206 | A1 * | 8/2013 | Bryant | H04N 1/622 | 345/600 |
| 2022/0361468 | A1 * | 11/2022 | Erdmann | A45F 3/04 | |

* cited by examiner

*Primary Examiner* — S. Joseph Morano
*Assistant Examiner* — Jovon E Hayes
(74) *Attorney, Agent, or Firm* — XSENSUS LLP

(57) ABSTRACT

An article holding device for a personal watercraft, the article holding device including: a pair of holders each having a holding portion capable of holding an article, in which each of the holders includes a lock portion detachably engaged to the watercraft body, and a coupling mechanism removably coupling both of the holders removed from the watercraft body.

20 Claims, 10 Drawing Sheets

ARTICLE HOLDING DEVICE AND PERSONAL WATERCRAFT

BACKGROUND

Technical Field

The present disclosure relates to an article holding device and a personal watercraft including the article holding device.

Background Art

A watercraft described in US 2013/0201206 A1 is known as a type of personal watercraft. In order to improve convenience of the personal watercraft, it is desirable to facilitate transportation of an article mounted on the personal watercraft.

SUMMARY

The present disclosure has been made in view of the above circumstance, and an object of the present disclosure is to provide an article holding device that can facilitate transportation of an article mounted on a personal watercraft.

An article holding device according to one aspect of the present disclosure is an article holding device for a watercraft body, the article holding device including: a pair of holders each having a holding portion capable of holding an article, in which each of the holders includes a lock portion detachably engaged to the watercraft body, and a coupling mechanism removably coupling both of the holders removed from the watercraft body.

DETAILED DESCRIPTION

Hereinafter, an embodiment of an article holding device and a personal watercraft including the article holding device according to the present disclosure will be described with reference to the drawings.

(Overall Configuration of Personal Watercraft)

Figure 1:
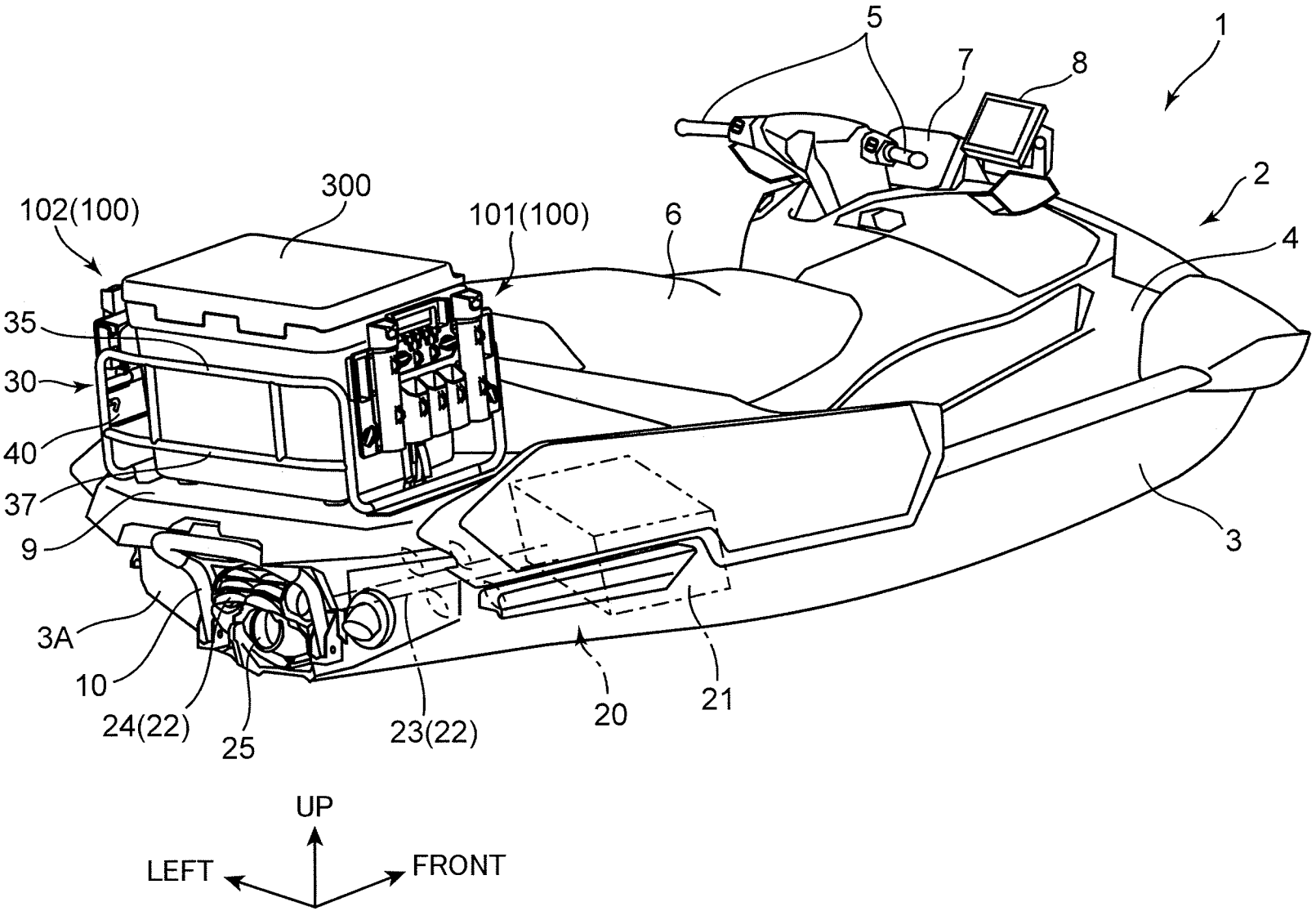
FIG. 1 is a schematic perspective view of a personal watercraft according to a first embodiment of the present disclosure.
Figure 2:
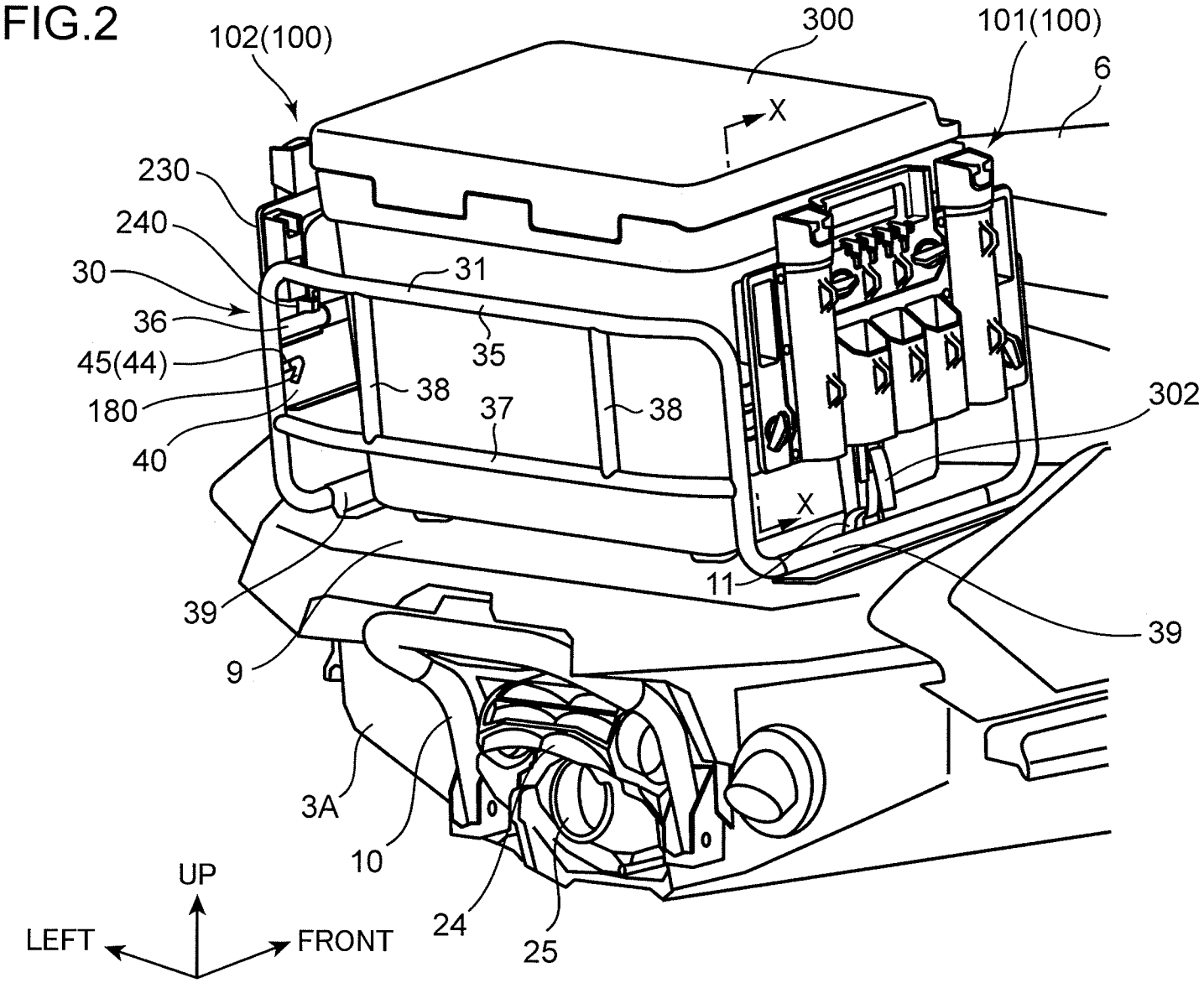
FIG. 2 is a partially enlarged view of the personal watercraft.
Figure 3:
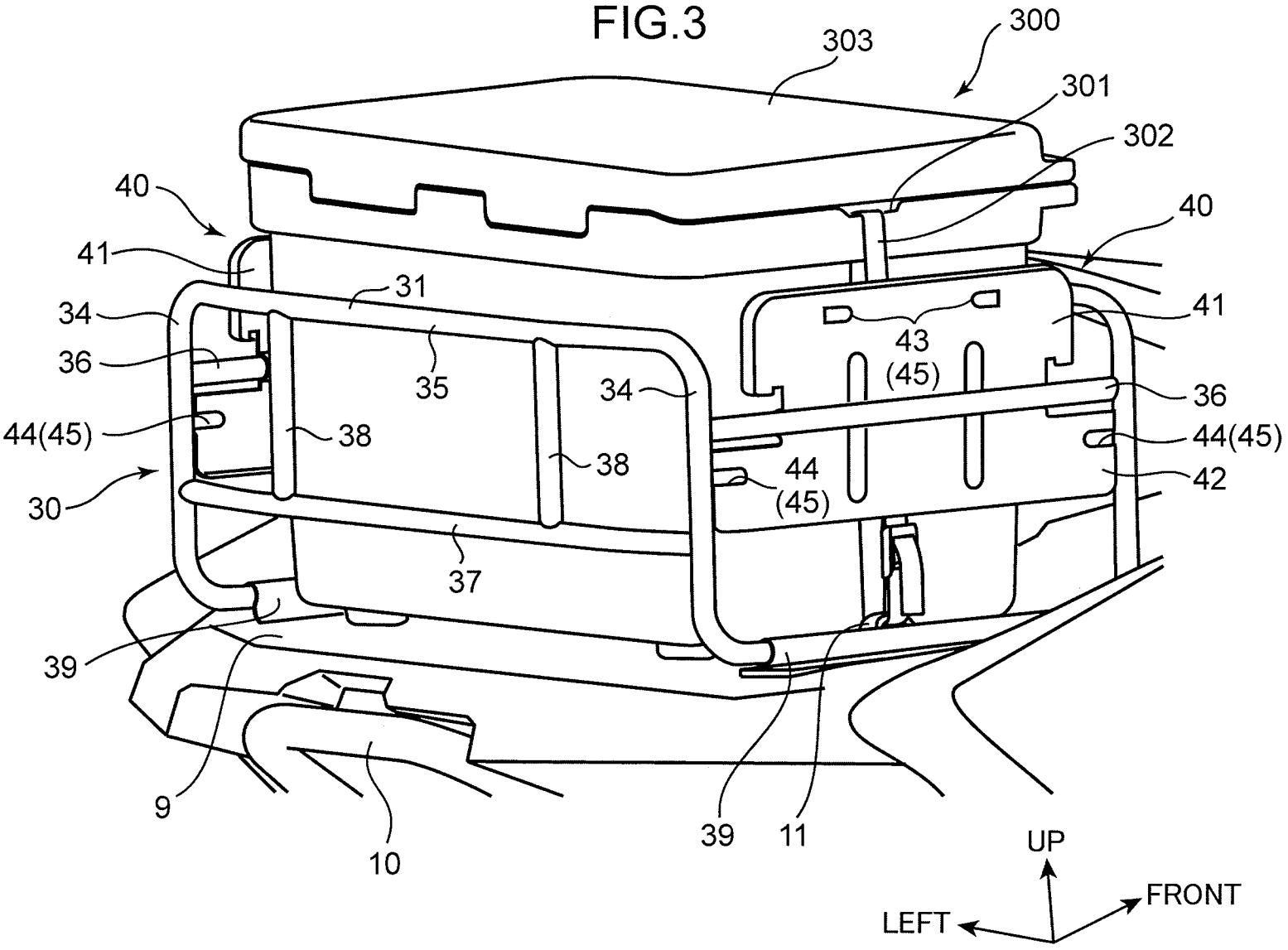
FIG. 3 is a partially enlarged view of a state where an article holding device is removed from the personal watercraft.
Figure 4:
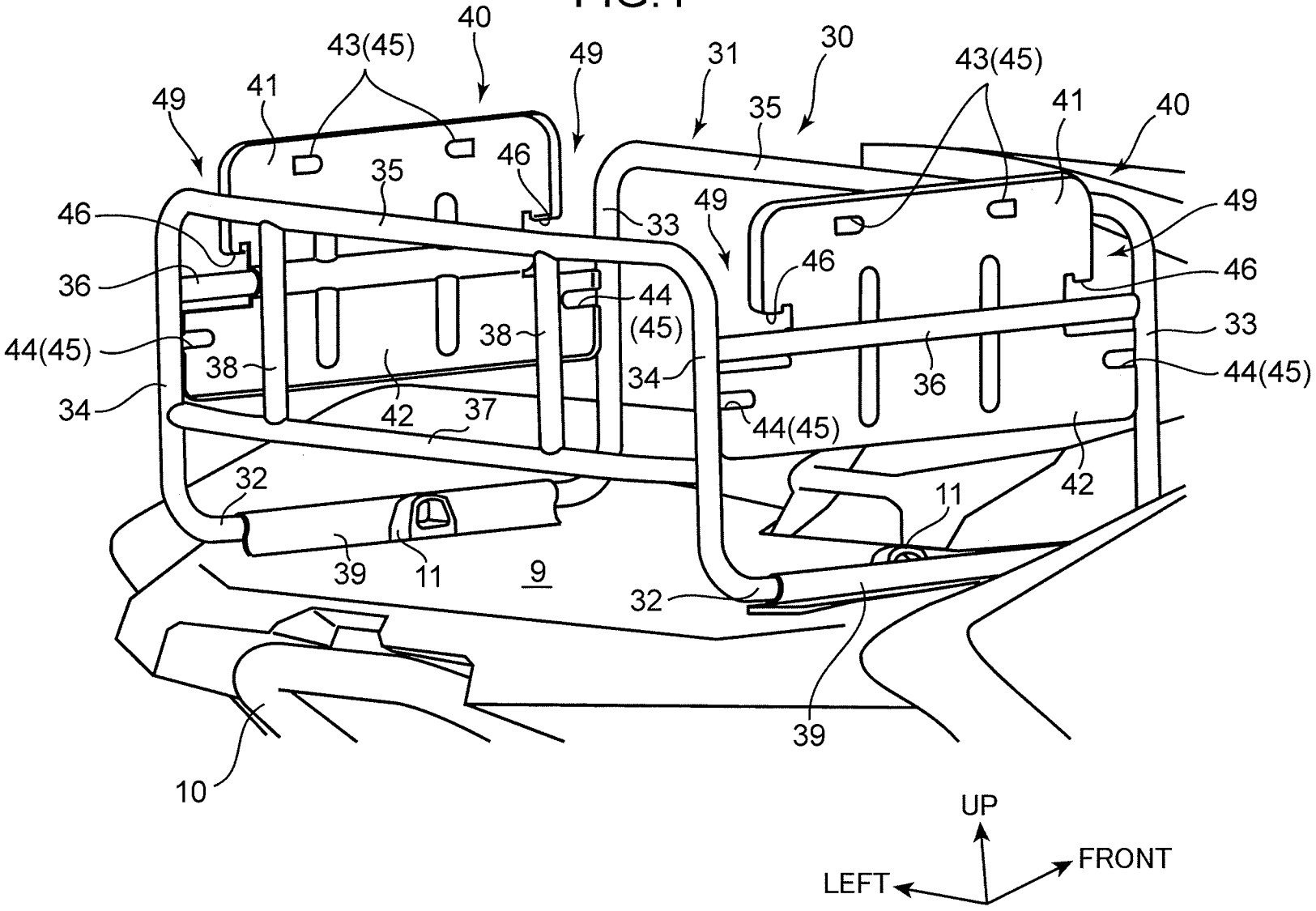
FIG. 4 is a partially enlarged view of a state where a cooler is removed from the personal watercraft.

FIG. 1 is a schematic perspective view of a personal watercraft 1 according to the first embodiment of the present disclosure, and FIG. 2 is a partially enlarged view of FIG. 1. FIGS. 1 and 2 illustrate the personal watercraft 1 in a state where a cooler 300 is mounted. FIG. 3 is an enlarged view of a part of the personal watercraft 1 in a state where an article holding device 100 described later is removed. FIG. 4 is an enlarged view of a part of the personal watercraft 1 in a state where the article holding device 100 and the cooler 300 are removed.

In the present embodiment, the personal watercraft 1 is a jet propulsion personal watercraft that jets a water flow backward and moves on water as a reaction. In the present embodiment, the personal watercraft is a straddle-type watercraft also called PWC. Therefore, the personal watercraft 1 is hereinafter abbreviated as PWC 1. The PWC 1 includes a watercraft body 2, a drive device 20 that applies a propulsive force to the watercraft body 2, and the article holding device 100. Hereinafter, a front-rear direction and a left-right direction of the watercraft body 2, the front-rear direction and the left-right direction viewed from an operator while operating the PWC 1 are simply called the front-rear direction and the left-right direction. Note that the directions illustrated in FIGS. 1 and 2, as well as FIGS. 3 and 4 described later, coincide with the above-described directions.

The watercraft body 2 includes a hull 3 and a deck 4 covering above the hull 3.

A handle 5, a seat 6, and a display 7 are arranged on the deck 4. In the present embodiment, the PWC 1 is mainly used for fishing. Thus, a fishfinder 8 is attached on the deck 4.

The handle 5 is a steering handle operated by the operator for steering the PWC 1. The seat 6 is a seat on which the operator who operates the PWC 1 sits. The seat 6 may be a seat for multiple persons on which not only the operator but also a passenger can sit, or may be a seat for one person on which only the operator can sit. The display 7 is an indicator that displays various types of information regarding the operation of the PWC 1, such as the moving speed and the remaining amount of fuel. The fishfinder 8 is a device that detects and displays the position of fish and the like in the water.

An upper surface of a rear deck 9, which is a part of the deck 4 on the rear side relative to the seat 6 and constitutes the rear part of the deck 4, is substantially flat. The rear deck 9 has a substantially rectangular shape extending in the front-rear direction and the left-right direction in plan view. A rear frame 30 is fixed to the rear deck 9. Details of the rear frame 30 will be described later.

The drive device 20 includes a propulsion device 22 that applies a propulsive force to the watercraft body 2 and an engine 21 for driving the propulsion device 22. In place of the engine 21 or in addition to the engine 21, an electric motor may be used as the drive device.

The propulsion device 22 includes a jet pump 23 that is driven by the engine 21 to jet water, and a reverse bucket 24 arranged at an outlet part of the jet pump 23. The engine 21 and the jet pump 23 are mounted inside the hull 3.

The jet pump 23 is a pump that generates a jet water flow. The jet pump 23 is rotationally driven by the engine 21 to pressurize and accelerate water, thereby generating a jet water flow. A rear end part of the watercraft body 2 is provided with a jet nozzle 25 for jetting a jet water flow. The jet nozzle 25 is attached to a rear wall portion 3A constituting the rear side surface of the hull 3 in a state of penetrating the rear wall portion 3A in the front-rear direction. The jet nozzle 25 is supported by the hull 3 so as to be swingable left and right according to the steering of the handle 5. When the jet nozzle 25 swings, the jet direction of the jet water flow jetted from the jet nozzle 25 is changed to left and right, thereby changing the traveling direction of the PWC 1.

The reverse bucket 24 is a device for reversing the watercraft body 2. The reverse bucket 24 is supported by the watercraft body 2 so as to be rotatable in the up-down direction. When the reverse bucket 24 is positioned above the jet nozzle 25, the PWC 1 moves forward. On the other hand, when the reverse bucket 24 rotates downward and is arranged at a position covering the jet nozzle 25, the PWC 1 moves backward. The position of the reverse bucket 24 is changed according to the operation of a lever (not illustrated) provided in the deck 4.

The rear wall portion 3A of the hull 3 is attached with a reboarding step 10. The reboarding step 10 is a device used as a footstep when a user of the PWC 1 such as the operator of the PWC 1 gets on the deck 4 from water. The reboarding step 10 is a pipe member having a substantially U shape. The reboarding step 10 is attached to the rear wall portion 3A of the hull 3 so as to surround the reverse bucket 24 and the jet nozzle 25. The reboarding step 10 is rotatably attached between a storage position along the rear wall portion 3A of the hull 3 as illustrated in FIG. 1 and a use position protruding rearward from the rear wall portion 3A of the hull 3. The reboarding step 10 is biased from the use position toward the storage position by a biasing unit (not illustrated), and the position of the reboarding step 10 in a normal state is the storage position. By rotating the reboarding step 10 present at the storage position to move the reboarding step to the use position, the user can use the reboarding step as a footstep.

(Rear Frame)

The rear frame 30 includes a body frame 31 and a pair of left and right holder support portions 40.

The body frame 31 includes a pair of left and right first pipes 32 and 32, a pair of left and right second pipes 33 and 33, a pair of left and right third pipes 34 and 34, a pair of front and rear fourth pipes 35 and 35, a pair of left and right fifth pipes 36 and 36, a first reinforcing pipe 37, and a pair of left and right second reinforcing pipes 38 and 38.

The first pipes 32 and 32 each have a rod shape extending in the front-rear direction. The two first pipes 32 and 32 are arranged near both left and right edges, respectively, of the rear deck 9. The second pipes 33 and 33 each have a rod shape extending in the up-down direction. The second pipes 33 and 33 extend upward from the front ends of the first pipes 32 and 32, respectively. The third pipes 34 and 34 each have a rod shape extending in the up-down direction. The third pipes 34 and 34 extend upward from the rear ends of the first pipes 32 and 32, respectively. The fourth pipes 35 and 35 each have a rod shape extending in the left-right direction. The fourth pipe 35 on the front side extends in the left-right direction across the upper ends of the second pipes 33 and 33. The fourth pipe 35 on the rear side extends in the left-right direction across the upper ends of the third pipes 34 and 34. The fourth pipes 35 and 35 are arranged near both edges in the front-rear direction of the rear deck 9 in plan view.

The first pipes 32 and 32, the second pipes 33 and 33, the third pipes 34 and 34, and the fourth pipes 35 and 35 are integrally formed with each other. For example, these pipes 32 to 35 are formed by bending one pipe member.

The fifth pipes 36 and 36 each have a rod shape extending in the front-rear direction. The fifth pipe 36 on the right side extends in the front-rear direction across an intermediate portion in the up-down direction of the second pipe 33 on the right side and an intermediate portion in the up-down direction of the third pipe 34 on the right side. The fifth pipes 36 and 36 are joined to the second pipe 33 and the third pipe 34 by welding or the like. The fifth pipes 36 and 36 correspond to the "frame member" of the present disclosure.

The first reinforcing pipe 37 has a rod shape extending in the left-right direction. The first reinforcing pipe 37 extends in the left-right direction across intermediate portions in the up-down direction of the third pipes 34 and 34. The first reinforcing pipe 37 extends substantially parallel to the fourth pipe 35 on the rear side and substantially horizontally. The first reinforcing pipe 37 is joined to the third pipes 34 and 34 by welding or the like.

The second reinforcing pipes 38 and 38 each have a rod shape extending in the up-down direction. The second reinforcing pipes 38 and 38 extend in the up-down direction across the fourth pipe 35 on the rear side and the first reinforcing pipe 37. The second reinforcing pipes 38 and 38 are joined to the first reinforcing pipe 37 and the fourth pipe 35 on the rear side by welding or the like.

The fourth pipe 35 on the rear side, the first reinforcing pipe 37, and the third pipes 34 and 34 are disposed near the rear edge of the rear frame 30 in plan view, and are positioned above the reboarding step 10. Here, the part of the body frame 31 constituted by the fourth pipe 35 on the rear side and a part of the third pipes 34 and 34 and the part of the body frame 31 constituted by the first reinforcing pipe 37 and a part of the third pipes 34 and 34 connect the rear end parts of the two fifth pipes 36 and 36, and the part constituted by the fourth pipe 35 on the rear side and a part of the third pipes 34 and 34 and the part constituted by the first reinforcing pipe 37 and a part of the third pipes 34 and 34 correspond to the "rear frame member" in the present disclosure.

The rear frame 30 including the body frame 31 configured as described above is fixed to the upper surface of the rear deck 9 by a rear frame fixing member 39 provided on the rear deck 9. Since the rear frame 30 is fixed to the rear deck 9, a space defined by the body frame 31 on the rear deck 9 and capable of accommodating loads and the like in a state of preventing falling of them is defined.

As described above, the PWC 1 of the present embodiment is a watercraft mainly used for fishing. Thus, as illustrated in FIG. 1 and the like, it is assumed that the cooler 300 is accommodated inside the body frame 31. In other words, in the present embodiment, the body frame 31 is configured to be capable of accommodating the cooler 300 inside thereof.

The rear deck 9 is provided with a belt insertion portion 11 to which the cooler 300 can be fixed. Specifically, a position in proximity to each of the first pipes 32 of the rear deck 9 is provided with a pair of the left and right belt insertion portions 11. The belt insertion portion 11 has a shape protruding upward from the upper surface of the rear deck 9. A through hole extending in the left-right direction is formed in the belt insertion portion 11. A common belt 302 is inserted and fixed to an insertion portion 301 provided in the cooler 300 for inserting a shoulder belt and the belt insertion portion 11, whereby the cooler 300 is fixed to the rear deck 9 in a state of being arranged inside the body frame 31. The cooler 300 in the illustrated example has a substantially cuboid outer shape, and is disposed on the rear deck 9 in a posture extending in the left-right direction. In the illustrated example, the cooler 300 is disposed such that a lid 303 constituting the upper part thereof rotates in the up-down direction about the rear edge.

The two holder support portions 40 are portions to which holders 101 and 102 described later, respectively, are detachably engaged. The two holder support portions 40 are disposed on the left and right sides of the rear frame 30, respectively. The two holder support portions 40 are supported by the fifth pipes 36 and 36, respectively. The two holder support portions 40 have shapes symmetrical to each other regarding the left-right direction. In the following description of the holder support portions 40, the holder support portion 40 on the right side will be described as a representative.

The holder support portion 40 has a substantially plate shape extending in the up-down direction and the front-rear direction. The holder support portion 40 is arranged between the second pipe 33 and the third pipe 34. The holder support portion 40 extends in the up-down direction straddling the fourth pipe 35, and includes an upper holder support portion 41 extending upward from the fourth pipe 35 and a lower holder support portion 42 extending downward from the fourth pipe 35.

The holder support portion 40 is joined to the fifth pipe 36 by welding or the like and is supported by the fifth pipe 36. The front end part of the lower holder support portion 42 is joined to the second pipe 33, and the rear end part of the lower holder support portion 42 is joined to the third pipe 34.

The lower holder support portion 42 extends in the front-rear direction across the second pipe 33 and the third pipe 34. On the other hand, the upper holder support portion 41 extends in the front-rear direction between a position rearward away from the second pipe 33 and a position forward away from the third pipe 34. Thus, gaps 49 are defined between the upper holder support portion 41 and the second pipe 33, and between the upper holder support portion 41 and the third pipe 34.

Two through holes 43 penetrating the front and back sides in the left-right direction are formed in the upper holder support portion 41. The two through holes 43 are formed near the upper end of the upper holder support portion 41 in a state of being separated from each other in the front-rear direction. These through holes 43 have a substantially rectangular shape extending in the front-rear direction.

The dimension in the front-rear direction of the lower end part of the upper holder support portion 41 is shorter than the dimension in the front-rear direction of the remaining part of the upper holder support portion 41. Thus, notches 46 and 46 recessed inward in the front-rear direction are defined by the upper holder support portion 41 and the fourth pipe 35, respectively, at both ends in the front-rear direction of the lower end part of the upper holder support portion 41. These notches 46 and 46 are portions into which a supported portion 140 of the holders 101 and 102 described later is inserted, and hereinafter, these two notches 46 and 46 are collectively called a supported portion notch 46 as appropriate.

The lower holder support portion 42 defines two through holes 44 and 44 at the front end part and the rear end part thereof, respectively. Specifically, a notch recessed rearward from the front edge is formed at the front end part of the lower holder support portion 42, and a notch recessed forward from the rear edge is formed at the rear end part of the lower holder support portion 42. As described above, the front end part of the lower holder support portion 42 is joined to the second pipe 33. Thus, the notch on the front side and the second pipe 33 define the through hole 44 penetrating in the left-right direction. Similarly, the rear end part of the lower holder support portion 42 is joined to the third pipe 34, and the notch on the rear side and the third pipe 34 define the through hole 44 penetrating in the left-right direction. Each of the through holes 44 defined by the lower holder support portion 42 has substantially the same shape as that of the through hole 43 formed in the upper holder support portion 41, and has a substantially rectangular shape extending in the front-rear direction.

The two through holes 43 and 43 formed in the upper holder support portion 41 and the two through holes 44 and 44 defined in the lower holder support portion 42 are holes for engaging a lock portion 181 of the holders 101 and 102 described later, and hereinafter, these four through holes 43, 43, 44, and 44 are collectively called lock portion engaging holes 45 as appropriate. The lock portion engaging hole 45 corresponds to the "lock engaging portion" of the present disclosure.

(Article Holding Device)

Figure 5:
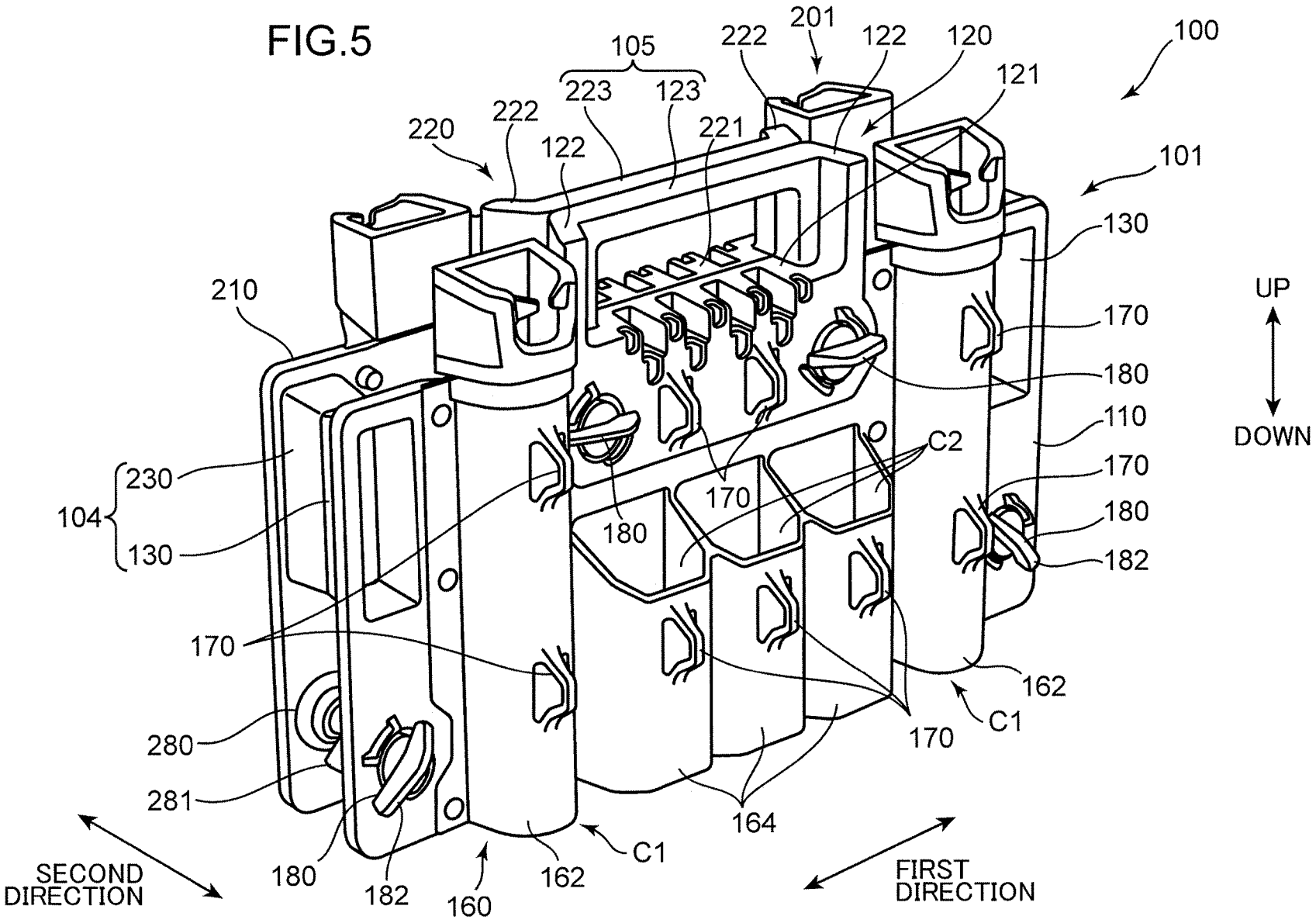
FIG. 5 is a perspective view illustrating the article holding device in a state where a first holder and a second holder are coupled.

FIG. 5 is a perspective view of the article holding device 100. The article holding device 100 includes a pair of the holders 101 and 102 removably coupled to each other. Hereinafter, as appropriate, one holder 101 is called a first holder 101, and the other holder 102 is called a second holder 102. Hereinafter, as appropriate, a state where the first holder 101 and the second holder 102 are coupled is called a holder coupled state, and a state where the first holder 101 and the second holder 102 are detached is called a holder separated state.

Figure 6:
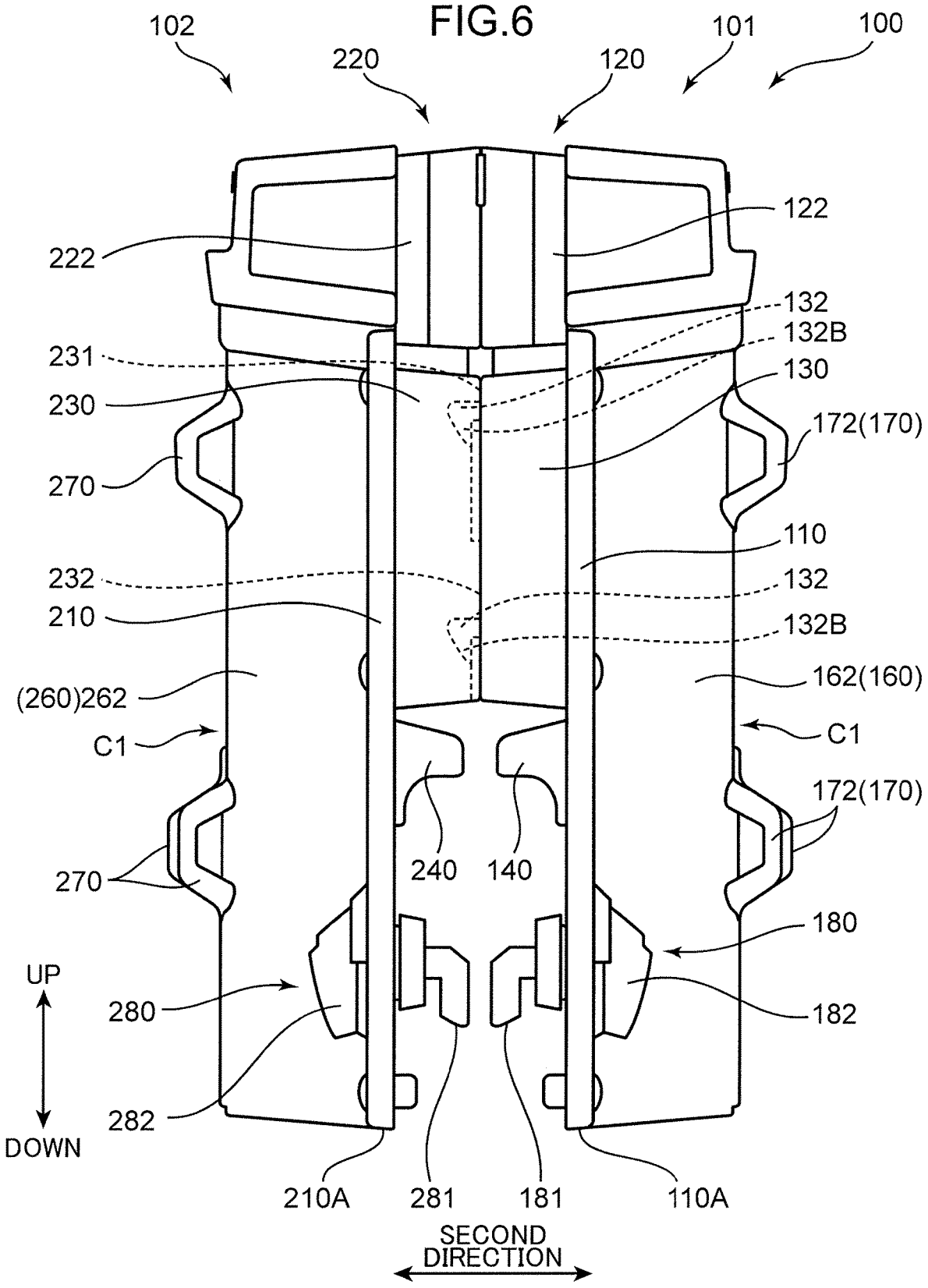
FIG. 6 is a side view illustrating the article holding device in a state where the first holder and the second holder are coupled.
Figure 7:
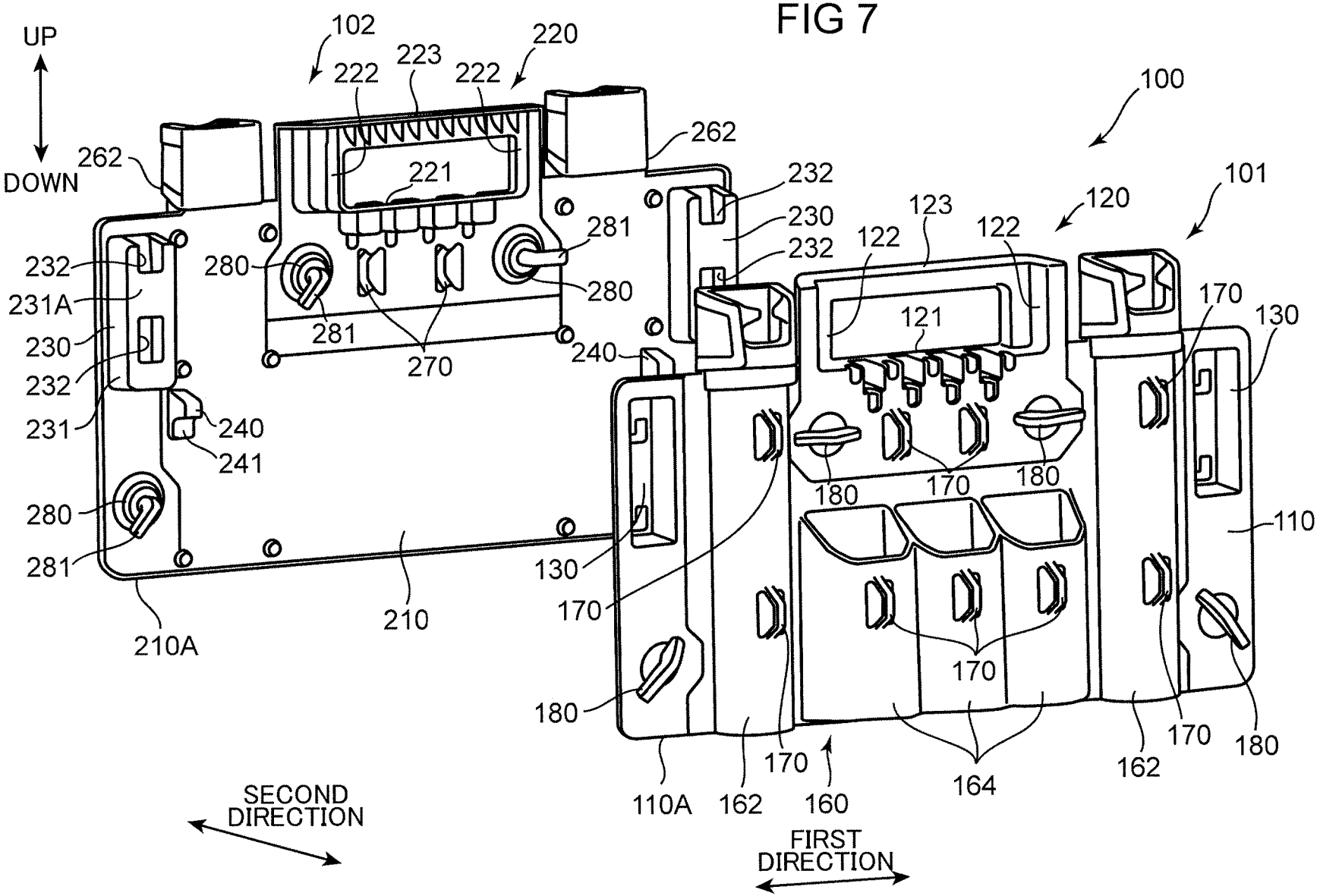
FIG. 7 is a perspective view illustrating the article holding device in a state where the first holder and the second holder are detached.
Figure 8:
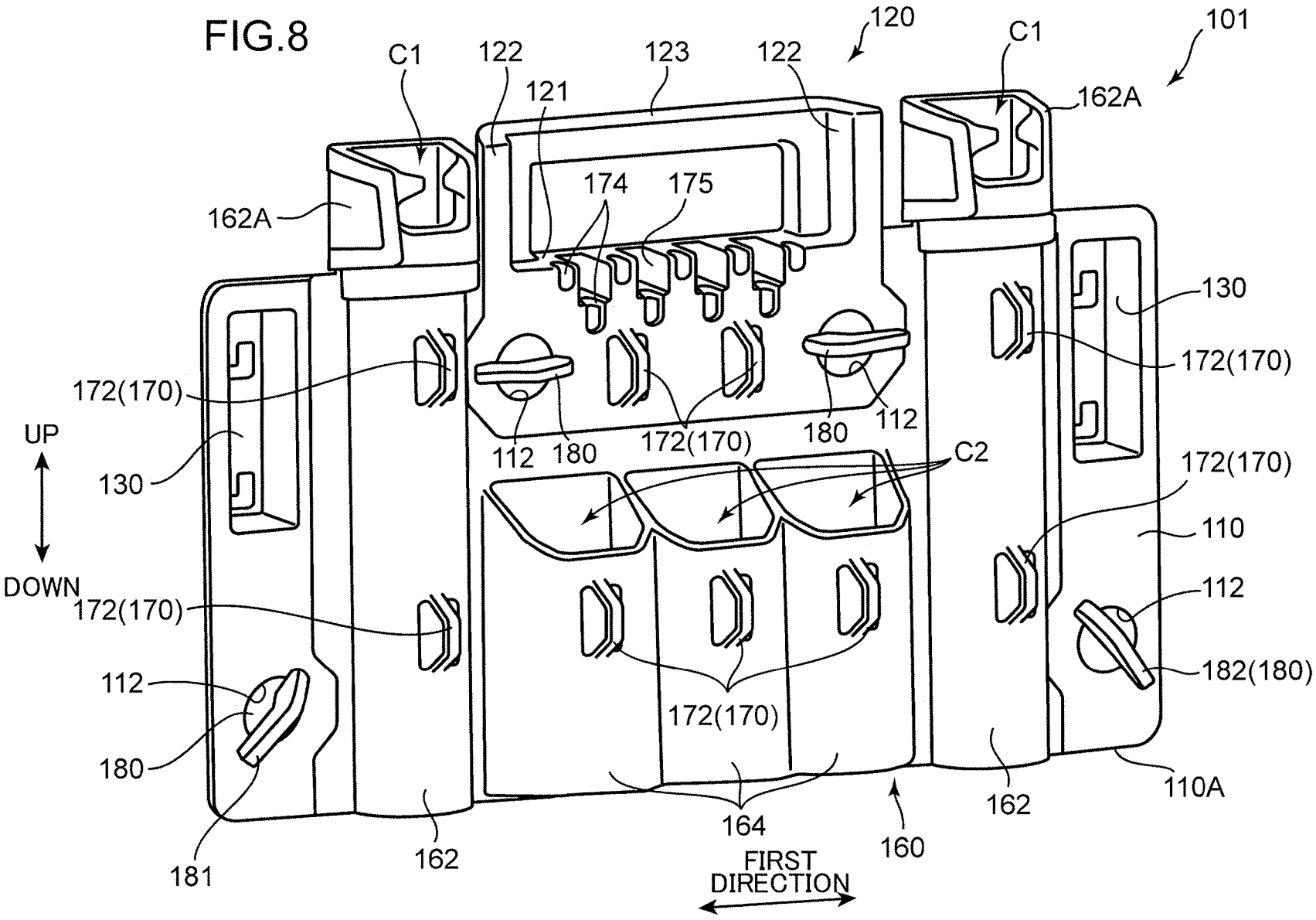
FIG. 8 is a perspective view of the first holder as viewed from a front side.
Figure 9:
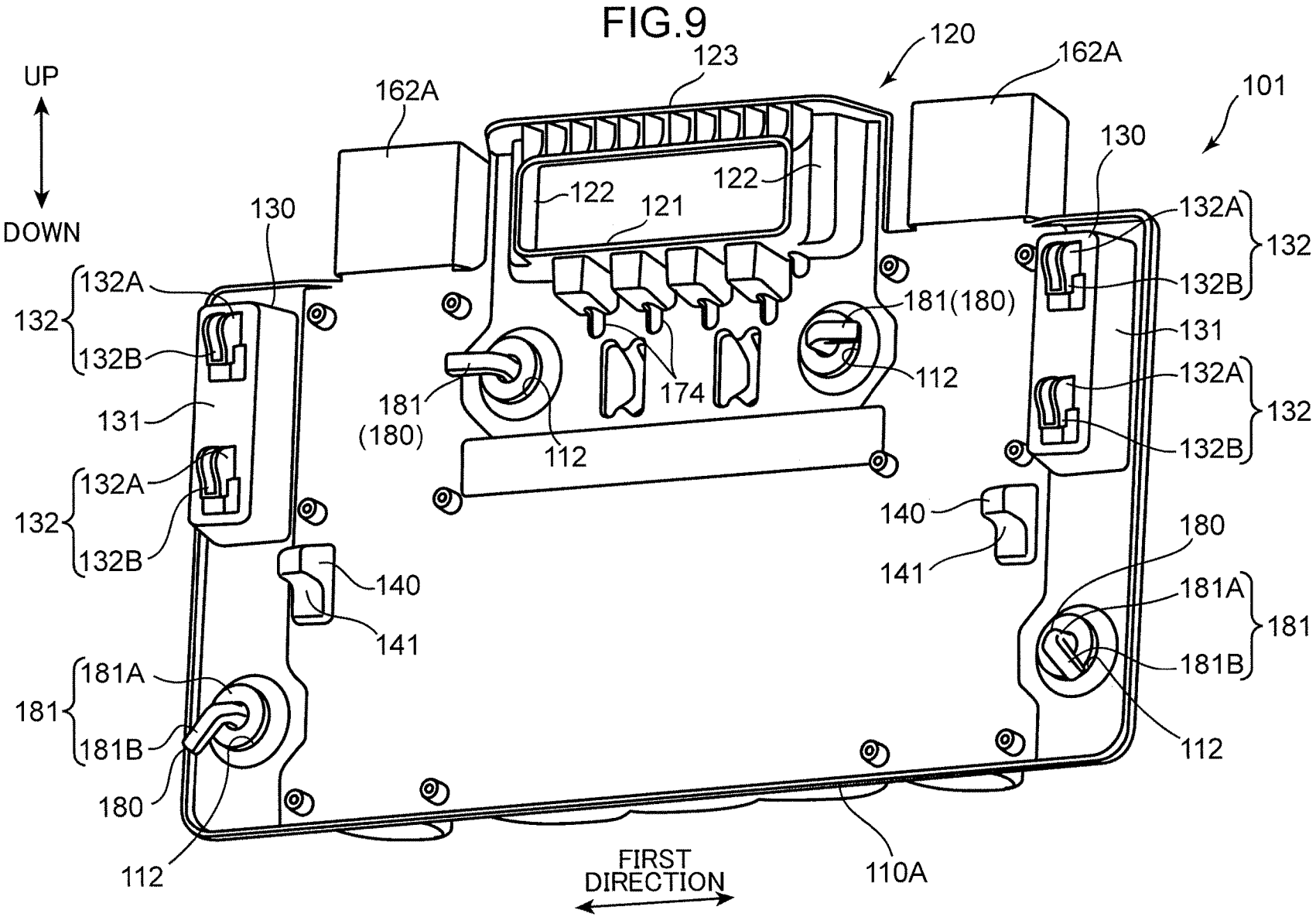
FIG. 9 is a perspective view of the first holder as viewed from a back side.
Figure 10:
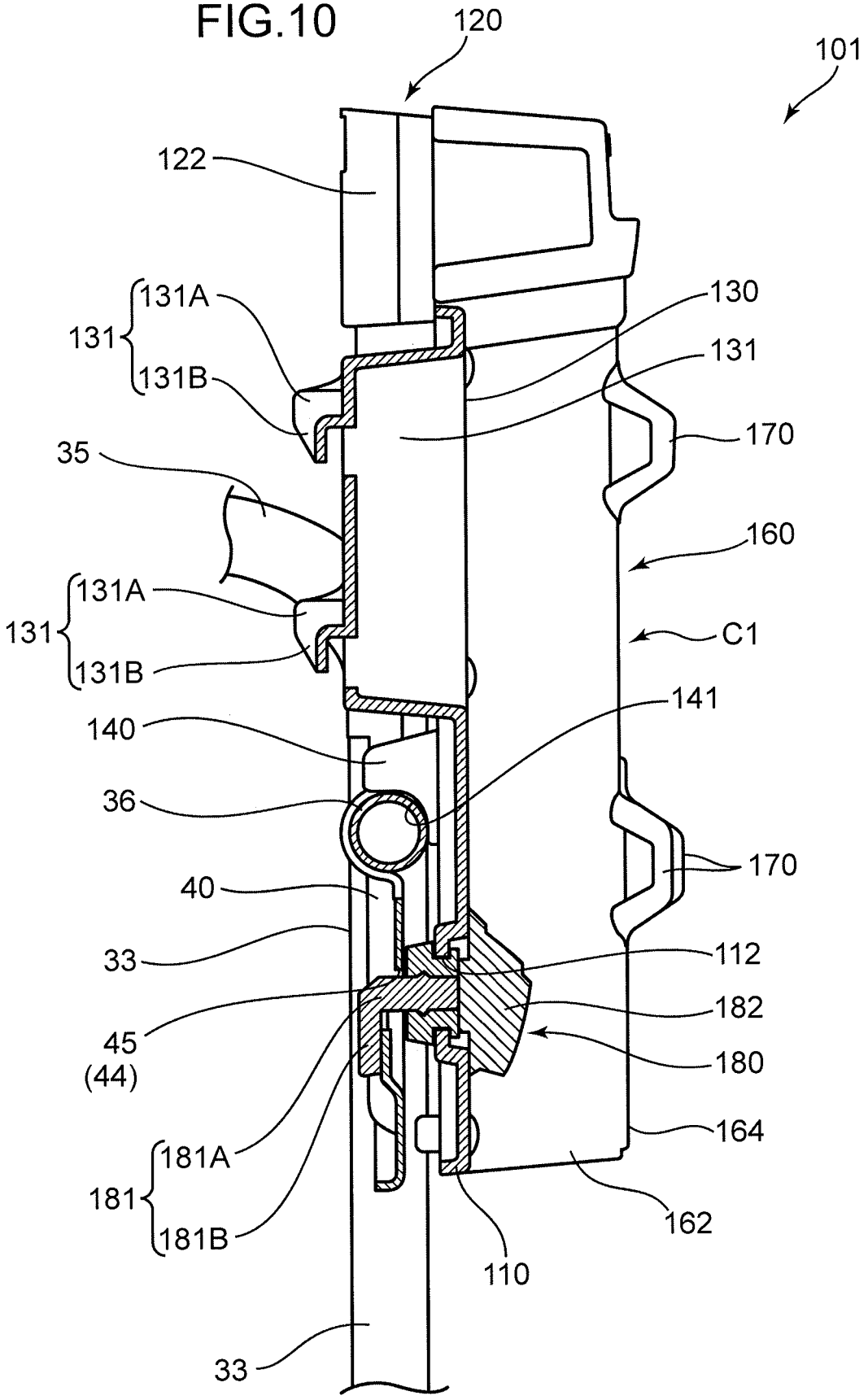
FIG. 10 is a cross-sectional view taken along line X-X of FIG. 2.

FIGS. 5 and 6 are a perspective view and a side view, respectively, of the article holding device 100 in the holder coupled state. FIG. 7 is a perspective view illustrating the article holding device 100 in the holder separated state. FIG. 8 is a perspective view of the first holder 101 as viewed from the front side. FIG. 9 is a perspective view of the first holder 101 as viewed from the back side. FIG. 10 is a cross-sectional view taken along line X-X of FIG. 2.

The first holder 101 and the second holder 102 have plate-shaped rear surface portions 110 and 210, respectively. The outer shape of each of the rear surface portions 110 and 210 is a substantially rectangular shape. The two holders 101 and 102 are coupled along a direction substantially orthogonal to the rear surface portions 110 and 210. That is, the coupling direction of the two holders 101 and 102 is a direction substantially orthogonal to the rear surface portions 110 and 210, and the rear surface portions 110 and 210 face each other in the holder coupled state. As illustrated in FIG. 1 and the like, the article holding device 100 and each of the holders 101 and 102 are used in a state where the rear surface portions 110 and 210 are substantially orthogonal to the horizontal direction. In the following description of the article holding device 100, the up-down direction in this use state is simply called the up-down direction. A horizontal direction along the long direction of the rear surface portions 110 and 210 is called a first direction, and a direction orthogonal to the up-down direction and the first direction is called a second direction.

The rear surface portions 110 and 210 have planar bottom surfaces 110A and 210A, respectively, extending along the first direction at the lower end parts thereof. In the present embodiment, a lower surface of the rib formed at the lower end part of the rear surface portions 110 and 210 constitutes the bottom surfaces 110A and 210A.

In addition to the rear surface portion 110, the first holder 101 includes a handle forming portion 120, a holder coupling portion 130, a plurality of the supported portions 140, a holding portion forming portion 160, a plurality of hooks 170, and a plurality of lock mechanisms 180. The holding portion forming portion 160 is fixed to one side in the front-back direction of the rear surface portion 110, that is, one side in the second direction. In the following description of the first holder 101, the holding portion forming portion 160 side with respect to the rear surface portion 110 regarding the second direction is called a front side, and the opposite side is called a back side.

In the present embodiment, the rear surface portion 110, the handle forming portion 120, the holder coupling portion 130, and the plurality of supported portions 140 are integrally formed with one another. For example, these are integrally molded with a resin. In the present embodiment, the holding portion forming portion 160 is riveted to the rear surface portion 110.

The handle forming portion 120 is a portion that forms a handle 105 that is grippable by the user in the holder coupled state. The handle forming portion 120 includes an extending part 121 extending from a front side edge in the second direction of the rear surface portion 110 to the back side, a pair of pillars 122 extending upward from both edges in the first direction of the extending part 121, and a grip part 123 extending in the first direction across upper end parts of the two pillars 122.

Each of the pillars 122 extends along the second direction in addition to the up-down direction. The grip part 123 extends across upper end parts of the both end parts on the back side in the second direction of the two pillars 122. Thus, regarding the second direction, the grip part 123 is positioned on the back side relative to the rear surface portion 110. A space penetrating in the second direction and into which the user can insert a hand is defined in a part surrounded by the grip part 123, the extending part 121, and the two pillars 122. The grip part 123 is provided at the center of the first holder 101 regarding the first direction, at a position where the center position of the grip part 123 substantially coincides with the center position of the rear surface portion 110.

A plurality of recess portions 175 arranged side by side in the second direction and recessed downward are formed in the extending part 121. The recess portions 175 are provided at positions separated from each other regarding the second direction. At a boundary part between the bottom surface of each of the recess portions 175 and the rear surface portion 110 and a boundary part between the part of the upper surface of the extending part 121 across each of the recess portions 175 and the rear surface portion 110, lure hanging portions 174 each including a through hole penetrating them in the up-down direction and the second direction is formed. The use method of the lure hanging portion 174 is not limited, but the user can hang a fishhook such as a lure hook on the lure hanging portion 174 and cause the first holder 101 to hold the lure. In the present embodiment, the first holder 101 is provided with four recess portions 175. Correspondingly, the first holder 101 has four lure hanging portions 174 provided in the recess portion 175 and five lure hanging portions 174 provided on the upper surface of the extending part 121.

The holder coupling portion 130 is a portion constituting a coupling mechanism 104 for coupling the two holders 101 and 102. The first holder 101 includes a pair of the holder coupling portions 130 arranged respectively at both end parts in the first direction in an upper part of the rear surface portion 110. The two holder coupling portions 130 have the same structure.

The holder coupling portion 130 includes a leg part 131 and a pair of upper and lower coupling protrusions 132 and 132. The leg part 131 protrudes from the rear surface portion 110 to the back side in the second direction. The leg part 131 is provided on the upper part of the rear surface portion 110. The leg part 131 has a substantially cuboid outer shape extending in the up-down direction. The two coupling protrusions 132 and 132 have the same structure and are arranged side by side in the up-down direction. The coupling protrusion 132 protrudes from the back side surface in the second direction of the leg part 131 to the back side. The coupling protrusion 132 includes a protrusion part 132A extending from the back side surface of the leg part 131 to the back side in the second direction, and a claw part 132B extending downward from the protrusion part 132A in a state where a gap is provided between the claw part 132B and the back side surface of the leg part 131.

The supported portion 140 is a portion supported by the holder support portion 40. The first holder 101 includes a pair of the supported portions 140 and 140 arranged respectively near both ends in the first direction of the rear surface portion 110. The two supported portions 140 and 140 have the same structure. The supported portion 140 protrudes from the rear surface portion 110 to the back side in the second direction. The supported portion 140 has a lower surface 141 curved so as to bulge upward. Specifically, the lower surface 141 of the supported portion 140 has a substantially ¼ arc shape curved so as to bulge upward and toward the front side in the second direction when viewed along the first direction. The two supported portions 140 and 140 are arranged substantially at the center in the up-down direction of the rear surface portion 110. As described later, the supported portion 140 is a portion placed on the fifth pipe 36 of the holder support portion 40 provided on the watercraft body 2, and the lower surface 141 of the supported portion 140 has a shape along a peripheral surface of the fifth pipe 36.

The holding portion forming portion 160 is a portion for holding an article in cooperation with the rear surface portion 110. The holding portion forming portion 160 includes a rod holder forming portion 162 and a small item case forming portion 164. The holding portion forming portion 160 includes a pair of the rod holder forming portions 162 and 162 arranged at positions separated from each other regarding the first direction, and three small item case forming portions 164, 164, and 164 arranged side by side in the second direction between the two rod holder forming portions 162 and 162. The two rod holder forming portions 162 and 162 have the same structure. The three small item case forming portions 164, 164, and 164 have the same structure. The two rod holder forming portions 162 and 162 and the three small item case forming portions 164, 164, and 164 are integrally formed with each other. For example, these are integrally molded with a resin.

The rod holder forming portion 162 has a substantially half tubular shape, extends in the up-down direction, and opens upward and downward. The rod holder forming portion 162 is disposed so as to bulge from the rear surface portion 110 to the front side in the second direction. The rod holder forming portion 162 and the rear surface portion 110 constitute a tubular rod holder C1 provided on the front side in the second direction of the first holder 101, the rod holder C1 extending in the up-down direction and opening upward and downward. The rod holder forming portion 162 and the rod holder C1 extend in the up-down direction over the entire length in the up-down direction of the rear surface portion 110. In the present embodiment, a tubular holder upper end part 162A communicating with the rod holder C1 is fixed to the upper ends of the rod holder forming portion 162 and the rod holder C1.

The small item case forming portion 164 has a substantially half tubular shape extending in the up-down direction. The small item case forming portion 164 opens upward and closes downward. The small item case forming portion 164 is disposed so as to bulge from the rear surface portion 110 to the front side in the second direction. The small item case forming portion 164 and the rear surface portion 110 constitute a tubular small item case C2 provided on the front side in the second direction of the first holder 101, extending in the up-down direction, and opening upward and closing downward. Regarding the up-down direction, the small item case forming portion 164 and the small item case C2 extend from substantially the center of the rear surface portion 110 to the vicinity of the lower end.

The handle forming portion 120 is arranged between the two rod holder forming portions 162 and the rod holder C1 regarding the first direction, and the small item case forming portion 164 and the small item case C2 are positioned below the handle forming portion 120.

Hereinafter, portions of the rod holder C1 and the small item case C2, the portions for holding an article, will be collectively called holding portions C1 and C2 as appropriate. The holding portions C1 and C2, that is, the rod holder C1 and the small item case C2 correspond to the "holding portion" in the present disclosure. The rod holder C1 corresponds to the "second holding portion" and the "tubular portion" in the present disclosure, and the small item case C2 corresponds to the "first holding portion" in the present disclosure.

The lock mechanism 180 is a portion for engaging the first holder 101 to the holder support portion 40 provided on the watercraft body 2. The first holder 101 has the plurality of lock mechanisms 180 having the same structure. A plurality of through holes 112 penetrating in the second direction of the front and back of the rear surface portion 110 is formed in the rear surface portion 110. Each of the lock mechanisms 180 is attached to this through hole 112. The first holder 101 has four lock mechanisms 180 and four through holes 112. The lock mechanism 180 includes the lock portion 181 rotatably held about an axis extending in the second direction, and an operation portion 182 coupled to the lock portion 181 for rotating the lock portion 181. As described later, the lock portion 181 is detachably engaged to the holder support portion 40.

The lock portion 181 includes a shaft portion 181A and a lock piece 181B. The shaft portion 181A is held in the through hole 112 in a posture protruding from the back side surface in the second direction of the rear surface portion 110 to the back side. The lock piece 181B extends from the end part on the back side in the second direction of the shaft portion 181A in a direction substantially orthogonal to the shaft portion 181A, that is, substantially parallel to the rear surface portion 110. The lock portion 181 is held on the rear surface portion 110 in a state where a gap is defined between the rear surface portion 110 and the lock piece 181B. The protrusion amount of the shaft portion 181A and the lock portion 181 from the rear surface portion 110 to the back side in the second direction is set to a dimension smaller than the protrusion amount of the leg part 131 of the holder coupling portion 130. Thus, the lock portion 181 is positioned on the front side relative to the leg part 131 of the holder coupling portion 130 regarding the second direction.

The operation portion 182 is arranged on the front side in the second direction of the rear surface portion 110 in a state of being coupled to the end part on the front side in the second direction of the shaft portion 181A. The operation portion 182 protrudes from the rear surface portion 110 to the front side in the second direction and has a shape extending in a direction substantially orthogonal to the shaft portion 181A of the lock portion 181. Thus, the user can rotate the lock portion 181 by pinching and rotating the operation portion 182 with fingers.

The four lock mechanisms 180 are arranged at positions recessed from surrounding portions thereof. Specifically, the two lock mechanisms 180 are provided at lower end parts of both end parts in the first direction of the rear surface portion 110, the lower end parts being provided at the rear surface portions 110 on both outer sides in the first direction of the two rod holder forming portions 162. The remaining two lock mechanisms 180 are provided at both end parts in the second direction of the part above the small item case forming portion 164 of the rear surface portion 110, the both end parts being both inner sides in the first direction of the two rod holder forming portions 162. That is, the holding portion forming portion 160 bulging from the rear surface portion 110 to the front side in the second direction is disposed around each of the lock mechanisms 180, and the lock mechanism 180 is disposed at a position recessed to the back side in the second direction as compared with the holding portion forming portion 160 around the lock mechanism 180 and the rod holder C1 configured by this provided around the lock mechanism 180.

The operation portion 182 is configured such that the protrusion amount of the operation portion 182 and the lock mechanism 180 from the rear surface portion 110 to the front side in the second direction is smaller than the protrusion amount of the holding portion forming portion 160. Thus, regarding the second direction, the operation portion 182 and the lock mechanism 180 are positioned on the back side relative to the holding portion forming portion 160.

The hook 170 is a portion to which a cord-like member such as a leash can be attached, and has an annular shape. Specifically, the hook 170 is configured to have an annular shape when viewed along the first direction. The first holder 101 has nine hooks 170. Seven hooks 170 are provided in the holding portion forming portion 160, and four hooks 170 are provided in the rear surface portion 110.

The hook 170 provided in the holding portion forming portion 160 includes a hook forming portion 172 that bulges from a front side surface in the second direction of the holding portion forming portion 160 to the front side, and the front side surface of the holding portion forming portion 160 around thereof. The two rod holder forming portions 162 are each provided with two hook forming portions 172 and hooks 170 arranged in the up-down direction. The three small item case forming portions 164 are each provided with one hook forming portion 172 and hook 170. In the present embodiment, a through hole 171 penetrating in the second direction is formed in a part facing the hook forming portion 172 of the front side surface of the holding portion forming portion 160, and the hook forming portion 172 straddles the corresponding through hole 171 in the up-down direction. In the present embodiment, the holding portion forming portion 160 and the seven hook forming portions 172 provided in this are integrally formed with each other.

The hook 170 provided in the rear surface portion 110 includes the hook forming portion 172 that bulges from the front side surface in the second direction of the rear surface portion 110 to the front side, and the front side surface of the rear surface portion 110 around thereof. Two hook forming portions 172 and hooks 170 are arranged side by side along the second direction in a part of the rear surface portion 110 above the small item case C2 and between the two lock mechanisms 180. In the present embodiment, similarly to the holding portion forming portion 160, the through hole 171 penetrating in the second direction is formed in a part facing the hook forming portion 172 of the rear surface portion 110, and the hook forming portion 172 straddles the corresponding through hole 171 in the up-down direction. In the present embodiment, the rear surface portion 110 and the two hook forming portions 172 provided in this are integrally formed with each other.

The first holder 101 and the second holder 102 have substantially symmetrical structures regarding the first direction in the holder coupled state. In the present embodiment, both the first holder 101 and the second holder 102 have symmetrical shapes regarding the first direction. Thus, the two holders 101 and 102 have substantially the same structure.

Specifically, similarly to the first holder 101, the second holder 102 includes a handle forming portion 220, a pair of the supported portions 240 and 240, a holding portion forming portion 260, a plurality of hooks 270, and a plurality of lock mechanisms 280. Similarly to the first holder 101, the handle forming portion 220 of the second holder 102 also includes an extending part 221, a pillar 222, and a grip part 223. The supported portions 240 and 240 of the second holder 102 also have a lower surface 241 curved so as to bulge upward. The holding portion forming portion 260 of the second holder 102 also includes a rod holder forming portion 262 and a small item case forming portion (not illustrated). The lock mechanism 280 of the second holder 102 also includes a lock portion 281 and an operation portion 282. Similarly to the first holder 101, the second holder 102 also includes a holder coupling portion 230 constituting the coupling mechanism 104 for coupling the two holders 101 and 102. The structures of the handle forming portion 220, the supported portions 240 and 240, the holding portion forming portion 260, the hook 270, and the lock mechanism 280 of the second holder 102 are the same as the structures of the respective elements of the first holder 101. On the other hand, the detailed structures of the holder coupling portion 230 of the second holder 102 and the holder coupling portion 130 of the first holder 101 are different from each other. Thus, the detailed structure of second holder 102 will be described only regarding the holder coupling portion 230, and description of other elements will be omitted. Hereinafter, as appropriate, the holder coupling portion 130 of the first holder 101 will be called a first holder coupling portion 130, and the holder coupling portion 230 of the second holder 102 will be called a second holder coupling portion 230.

The second holder 102 includes a pair of the second holder coupling portions 230 arranged respectively at both end parts in the first direction in the upper part of the rear surface portion 210. The two second holder coupling portions 230 have the same structure.

The second holder coupling portion 230 has a leg part 231 protruding from the rear surface portion 210 to the back side in the second direction. The outer shape of the leg part 231 of the second holder coupling portion 230 is substantially the same as the outer shape of the leg part 131 of the first holder coupling portion 130, and has a substantially cuboid outer shape extending in the up-down direction. The leg part 231 of the second holder coupling portion 230 is provided at a position facing the leg part 131 of the first holder coupling portion 130 in the holder coupled state.

Unlike first holder coupling portion 130, a coupling engaging hole 232 is formed on the back side surface in the second direction of the second holder coupling portion 230, that is, the back side surface of the leg part 231. Specifically, the second holder coupling portion 230 has a vertical wall part 230A constituting the back side surface of the leg part 231. The coupling engaging hole 232 penetrating the vertical wall part 230A in the second direction is formed in the vertical wall part 230A. The second holder coupling portions 230 are respectively provided with the two coupling engaging holes 232 arranged in the up-down direction. Each of the coupling engaging holes 232 has a substantially rectangular shape extending in the up-down direction. The coupling engaging hole 232 on the upper side opens upward in addition to the second direction. The coupling engaging hole 232 of the second holder coupling portion 230 is provided at a position facing each of the claw parts 132B of the first holder coupling portion 130 in the holder coupled state.

(Coupling Structure Between Holders)

The first holder 101 and the second holder 102 configured as described above are coupled to each other by engaging each of the claw parts 132B of the first holder coupling portion 130 with the second holder coupling portion 230.

Specifically, the first holder 101 and the second holder 102 are brought close to each other along the second direction in a state where the back side surfaces in the second direction of the rear surface portions 110 and 210 face each other, and each of the claw parts 132B of the first holder coupling portion 130 is inserted into the coupling engaging hole 232 of the second holder coupling portion 230 facing to the claw parts 132B. Thereafter, the first holder 101 is moved downward with respect to the second holder 102, and the vertical wall part 230A of the second holder 102 is inserted into the gap between the back side surface in the second direction of the leg part 131 of the first holder coupling portion 130 and the claw parts 132B. Due to this, the claw part 132B and the coupling protrusion 132 are engaged to the second holder coupling portion 230. The relative movement regarding the second direction between the first holder 101 and the second holder 102 is restricted, and are coupled to each other. When the first holder 101 and the second holder 102 are decoupled, the claw part 132B of the first holder coupling portion 130 may be detached from the coupling engaging hole 232 of the second holder coupling portion 230 by moving the first holder 101 upward with respect to the second holder 102 and then moving the first holder 101 and the second holder 102 in a direction of separating from each other along the second direction.

With the above coupling structure, in the holder coupled state, the rear surface portion 110 of the first holder 101 and the rear surface portion 210 of the second holder 102 are arranged at positions separated from each other regarding the second direction. In the holder coupled state, the holding portions C1 and C2 of the first holder 101 and the holding portions C1 and C2 of the second holder 102 are also arranged at positions separated from each other regarding the second direction. In other words, the first holder coupling portion 130 and the second holder coupling portion 230 couple the two holders 101 and 102 such that the rear surface portions 110 and 210 and the holding portions C1 and C2 are separated from each other regarding the second direction.

In the holder coupled state, the height positions of the bottom surfaces 110A and 210A of the respective holders 101 and 102 become the same as each other, and these bottom surfaces 110A and 210A are arranged at positions extending along the first direction on the same plane. In other words, the first holder coupling portion 130 and the second holder coupling portion 230 couple the two holders 101 and 102 such that the bottom surfaces 110A and 210A of the respective holders 101 and 102 extend along the first direction on the same plane. Specifically, regarding the up-down direction, the separation distance between the lower end of the claw part 132B and the bottom surface 101A of the first holder 101 is set to be substantially the same as the separation distance between the lower end of the corresponding coupling engaging hole 232 and the bottom surface 210A of the second holder 102, whereby the bottom surfaces 110A and 210A are arranged on the same plane in the holder coupled state. As described above, since the holders 101 and 102 are coupled such that the rear surface portions 110 and 210 face each other, the bottom surfaces 110A and 210A of the rear surface portions 110 and 210 are brought into a state of extend along the first direction in the holder coupled state.

In the holder coupled state, the handle forming portion 120 of the first holder 101 and the handle forming portion 220 of the second holder 102 constitute the handle 105 of the article holding device 100 in cooperation. Specifically, in the holder coupled state, each of the grip parts 123 and 223 is arranged to extend along the first direction in a state of being in contact with or in proximity to each other regarding the second direction. In the holder coupled state, spaces below of the grip parts 123 and 223 communicate with each other. This enables the user to simultaneously grip the two grip parts 123 and 223 in a state where the hand is inserted into the space. In this manner, the two handle forming portions 120 and 220 constitute one handle 105 capable of simultaneously gripping the two holders 101 and 102. The handle 105 is formed substantially at the center in the first direction and the second direction of the upper end part of the article holding device 100 in the holder coupled state.

Here, as described above, the grip part 123 (223) is provided at a position on the back side in the second direction relative to the rear surface portion 110 (120). Thus, in the holder coupled state, each of the rear surface portions 110 and 210 and the holding portions C1 and C2 are arranged at positions separated from each other across the handle 105 configured by the two grip parts 123 and 223 regarding the second direction. In other words, the holders 101 and 102 are coupled such that each of the rear surface portions 110 and 210 and the holding portions C1 and C2 are separated from each other across the handle 105 regarding the second direction.

In the present embodiment, regarding the second direction, the gap dimension between the back side surface of the leg part 131 of the first holder coupling portion 130 and the claw part 132B is set to be substantially the same dimension as the thickness of the vertical wall part 230A of the leg part 231 of the second holder 102. Thus, in the holder coupled state, the back side surfaces of the leg part 131 of the first holder coupling portion 130 and the leg part 231 of the second holder coupling portion 230 are in contact with each other substantially entirely. Along with this, the rear surface portion 110 of the first holder 101 and the rear surface portion 210 of the second holder 102 are separated from each other regarding the second direction by substantially the same distance as the total dimension of the second direction of the respective leg parts 131 and 231 of the first holder coupling portion 130 and the second holder coupling portion 230. In the present embodiment, in each of the holders 101 and 102, the back side surfaces of the leg parts 131 and 231 and the positions of the end parts on the back sides of the grip parts 123 and 223 are set to be substantially the same regarding the second direction. Thus, as described above, the two holders 101 and 102 are coupled in a state where the back side surfaces of the leg part 131 of the first holder coupling portion 130 and the leg part 231 of the second holder coupling portion 230 are in contact with each other, and the grip parts 123 and 223 are in contact with or in proximity to each other.

In the holder coupled state, the lock portion 181 of the first holder 101 and the lock portion 181 of the second holder 102 are arranged at positions facing each other regarding the second direction. However, as described above, in each of the holders 101 and 102, the lock portions 181 and 281 are positioned on the front side of the leg parts 131 and 231 of the holder coupling portions 130 and 230 regarding the second direction. Thus, in the holder coupled state, the lock portions 181 of the first holder 101 and the lock portions 181 of the second holder 102 facing each other are arranged at positions separated from each other regarding the second direction. In other words, the holders 101 and 102 are coupled in a state where the lock portions 181 of the holders 101 and 102 are separated from each other regarding the second direction.

(Attachment Structure of Holder to Watercraft Body)

The first holder 101 and the second holder 102 configured as described above are individually removably attached to the holder support portions 40 and 40, respectively. The holders 101 and 102 are respectively attached to the holder support portion 40 in a posture in which the holding portion forming portion 160 and the holding portions C1 and C2 face outward in the left-right direction of the watercraft body 2 and the grip parts 123 and 223 are positioned at the upper end of the respective holders 101 and 102. Attachment procedures and attachment structures of the holders 101 and 102 to the holder support portions 40 and 40 are the same (symmetrical). Hereinafter, the attachment procedure and the attachment structure in a case of attaching the first holder 101 to the holder support portion 40 on the right side will be described.

The first holder 101 is fixed to the holder support portion 40 by engaging each of the lock portions 181 to the holder support portion 40.

Specifically, the first holder 101 is brought close to the first holder 101 from the right in a posture in which the holding portions C1 and C2 are positioned on the right side of the rear surface portion 110. Then, while each of the lock portions 181 is inserted into the lock portion engaging hole 45, the two supported portions 140 are each inserted into the supported portion notch 46. Then, the lower surface 141 of the supported portion 140 is placed on the upper surface of the fifth pipe 36. When the lower surface 141 of the supported portion 140 is placed on the upper surface of the fifth pipe 36, the first holder 101 is supported by the fifth pipe 36. The insertion of the lock portion 181 into the lock portion engaging hole 45 is performed in a state where the lock portion 181 is in a posture extending in the front-rear direction corresponding to the shape of the lock portion engaging hole 45.

Next, the operation portion 182 of each of the lock mechanisms 180 is rotated to change the posture of the lock portion 181 to a posture in which the lock portion 181 is not detached from the lock portion engaging hole 45. In the present embodiment, the operation portion 182 is rotated so that the lock portion 181 becomes in a posture extending in the up-down direction. Due to this, the lock portion 181 is engaged to the holder support portion 40, and the first holder 101 is fixed to the watercraft body 2.

The first holder 101 fixed to the watercraft body 2 as described above is removed from the watercraft body 2 by releasing the lock of each of the lock portions 181 to the holder support portion 40. Specifically, the operation portion 182 of each of the lock mechanisms 180 is rotated to change the posture of the lock portion 181 to a posture of passing through the lock portion engaging hole 45. This releases the lock of the lock portion 181 to the holder support portion 40. Therefore, thereafter, the first holder 101 is moved rightward while allowing the lock portion 181 to pass through the lock portion engaging hole 45. Due to this, the first holder 101 is removed from the watercraft body 2.

As described above, in the present embodiment, in the state where the first holder 101 is attached to the holder support portion 40, the lock portion 181 is inserted into the lock portion engaging hole 45, and the lower surface 141 of the supported portion 140 is placed on the upper surface of the fifth pipe 36. In other words, the holder support portion 40 is configured to achieve this structure. That is, the lock portion engaging holes 45 are provided at positions corresponding to the respective lock portions 181, and the supported portion notch 46 is provided at a position corresponding to each of the supported portions 140.

In the state where the first holder 101 is attached to the holder support portion 40, the two holder coupling portions 130 of the first holder 101 are inserted into the two gaps 49 defined respectively by the holder support portion 40 and the pipes 33, 34, and 36 of the rear frame 30. In other words, the gap 49 is formed at a position corresponding to the holder coupling portion 130 in a state where the first holder 101 is attached to the holder support portion 40. In the state where the first holder 101 is attached to the holder support portion 40, the handle forming portion 120 is arranged at a position above the holder support portion 40. In other words, the holder support portion 40 is configured to be positioned below the handle forming portion 120 in the state where the first holder 101 is attached to the holder support portion 40. With these configurations, in the present embodiment, interference between the holder coupling portion 130 and the handle forming portion 120 including a part positioned on the left side relative to the rear surface portion 110, that is, on the back side in the second direction and the holder support portion 40 is avoided. Therefore, the first holder 101 is attached to the holder support portion 40 in a posture in which the rear surface portion 110 of the first holder 101 extends in parallel to the holder support portion 40 at a position in proximity to the holder support portion 40.

Operations and Effects

As described above, the article holding device 100 of the present embodiment includes the pair of holders 101 and 102 respectively having the holding portions C1 and C2 capable of holding an article, and each of the holders 101 and 102 includes the lock portion 181 detachably engaged to the watercraft body 2 and the coupling mechanism 104 that removably couples both the holders 101 and 102 removed from the watercraft body 2.

Thus, according to the article holding device 100 of the present embodiment, it is possible to reduce time and effort when loading and unloading a plurality of articles onto and from the watercraft body 2. Specifically, by engaging the holder 101 (102) to the watercraft body 2 in a state where the plurality of articles are held by the holding portions C1 and C2, it is possible to load the plurality of articles simultaneously onto the watercraft body 2. Moreover, it is possible to maintain each article in a state of being held by the holder 101 (102). Therefore, it is not necessary to hold each article again by another device in the watercraft body 2, and it is possible to reduce time and effort at the time of loading. At the time of disembarking, by removing the holder 101 (102) from the watercraft body 2, it is possible to detach the plurality of articles from the watercraft body 2 at a time and unload them from the watercraft body 2. Therefore, it is not necessary to individually unload the plurality of articles from the watercraft body 2 or to store the plurality of articles again in another device in order to unload the plurality of articles from the watercraft body 2, and it is possible to reduce time and effort for unloading. Furthermore, by coupling the two holders 101 and 102 in a state where the articles are held by the respective holding portions C1 and C2, it is possible to put together the plurality of articles. Therefore, it is possible to transport the plurality of articles at once between a predetermined position on the land and the watercraft body 2 and between the land and the watercraft body 2. Therefore, it becomes possible to easily transport the plurality of articles.

In particular, in the article holding device 100 of the present embodiment, the holder 101 (102) can be engaged to the holder support portion 40 by rotationally operating the operation portion 182 of the lock mechanism 180 in a state where the lock portion 181 of the lock mechanism 180 is inserted into the lock portion engaging hole 45 of the holder support portion 40. Therefore, it is possible to easily engage the holder 101 (102) to the watercraft body 2.

In the article holding device 100 of the present embodiment, in the holder coupled state, the handle forming portions 120 and 220 of each of the holders 101 forms the handle 105 with which the user can simultaneously grip the two holders 101 and 102. Therefore, it becomes easy to transport the two holders 101 and 102 and eventually the articles held by them.

In the article holding device 100 of the present embodiment, the holders 101 and 102 are coupled such that the rear surface portions 110 and 210 and the holding portions C1 and C2 are separated from each other across the handle 105 regarding the second direction. Therefore, the holding portions C1 and C2 of the respective holders 101 and 102 and the weight of the articles held by these can be distributed to both sides across the handle 105 regarding the second direction. Therefore, it is possible to stabilize the posture of the article holding device 100 in a state where the user grips the handle 105, and it is possible to improve the workability of transportation work of the article holding device 100 and the articles held by this.

In the article holding device 100 of the present embodiment, the holders 101 and 102 are coupled in a state where the lock portions 181 of the holders 101 and 102 are separated from each other regarding the second direction, that is, the coupling direction of the holders 101 and 102. Therefore, it is possible to prevent the lock portions 181 of the holders 101 and 102 from interfering with each other when the first holder 101 and the second holder 102 are coupled, and it is possible to suppress damage to the lock portions 181.

In the article holding device 100 of the present embodiment, the operation portions 182 of the four lock mechanisms 180 are arranged at positions recessed from the surrounding parts, and the operation portion 182 of each of the lock mechanisms 180 is also arranged at a position recessed from the surrounding part. That is, the operation portion 182 of each of the lock mechanisms 180 is arranged at a position difficult to access in a state where holders 101 and 102 are attached to the holder support portion 40.

Therefore, it is possible to prevent the operation portion 182 from being unexpectedly operated due to a user's hand or another article accidentally hitting the operation portion 182, and it is possible to prevent the holders 101 and 102 from being unintentionally detached from the holder support portion 40.

In particular, in the article holding device 100 of the present embodiment, each of the operation portions 182 is disposed around the holding portion forming portion 160 and the holding portions C1 and C2 and at positions recessed from the holding portion forming portion 160 and the holding portions C1 and C2. Therefore, it is possible to prevent an unexpected operation of each of the operation portions 182 using the holding portion forming portion 160 and the holding portions C1 and C2.

In the article holding device 100 of the present embodiment, in the holder coupled state, the bottom surfaces 110A and 210A of the rear surface portions 110 and 210 of the respective holders 101 and 102 assume a posture of extending along the same plane. Therefore, it is possible to ground the bottom surfaces 110A and 210A of the respective rear surface portions 110 and 210 together. In the holder coupled state, the bottom surfaces 110A and 210A assume a posture of extending in the first direction, that is, the direction orthogonal to the second direction at positions separated from each other regarding the second direction, that is, the coupling direction of the holders 101 and 102. Therefore, it becomes possible to stably ground each of the holders 101 and 102 and to cause them to stand by itself. Since each of the holders 101 and 102 is caused to stand by itself, in the article holding device 100 of the present embodiment, each of the holders 101 and 102 in the holder coupled state can be temporarily placed on the ground or the watercraft body 2. Therefore, convenience at the time of transporting each of the holders 101 and 102 and the articles held by these is improved.

In the article holding device 100 of the present embodiment, the holders 101 and 102 are provided with the supported portions 140 and 240, respectively. Then, the lock portion 181 can be engaged to the holder support portion 40 in a state where the lower surfaces 141 and 241 of the supported portions 140 and 240 are placed on the upper surface of the fifth pipe 36 of the holder support portion 40 and the holders 101 and 102 are supported by the fifth pipe 36. That is, the holders 101 and 102 are provided with the respective supported portions 140 and 240 supported by the holder support portion 40 and eventually the watercraft body 2 at a position where the lock portion 181 is engaged to the holder support portion 40 and eventually the watercraft body 2.

Therefore, it is possible to lock the lock portion 181 to the holder support portion 40 and eventually the watercraft body 2 in a state where each of the holders 101 and 102 is stable. This facilitates the engaging operation of the lock portion 181.

In the article holding device 100 of the present embodiment, each of the holders 101 and 102 is provided with the rod holder C1 extending in the up-down direction and opening upward and downward. Therefore, it is possible to cause the rod holder C1 to hold a long article, and to easily transport and mount this onto the watercraft body 2. In particular, at the time of fishing, it is possible to effectively enhance convenience because it is possible to cause the rod holder C1 to hold a rod for fishing and a net for fishing. When the rod or the net is held by the rod holder C1, a reel mounted to the rod and a middle part of the net are only required to be hooked to the upper end part of the rod holder C1 or the like, whereby the rod and the net are held by the rod holder C1.

In the article holding device 100 of the present embodiment, each of the holders 101 and 102 is provided with the small item case C2 extending in the up-down direction and opening upward and closing downward. Therefore, it is possible to cause the small item case C2 to hold also an article that drops from the rod holder C1 when put into the rod holder C1, and it is possible to enhance convenience. For example, at the time of fishing, it is possible to cause the small item case C2 to hold a tool such as a fish grip for gripping fish and a pliers for removing a hook from fish.

In the article holding device 100 of the present embodiment, the small item case C2 is arranged below the handle forming portions 120 and 220 of the respective holders 101 and 102, and it is possible to cause the article holding device 100 to hold an article using the spaces below the handle forming portions 120 and 220. In the holder coupled state, it is possible to arrange an article at a position close to the handle 105, and it is possible to enhance the stability of the article holding device 100 in a state where the handle 105 is gripped.

In each of the holders 101 and 102, the rod holder C1 is arranged at a position separated from each other regarding the second direction across the small item case C2 and the handle forming portions 120 and 220. Therefore, it is possible to cause the article holding device 100 to hold the article by effectively using the spaces around the handle forming portions 120 and 220 and eventually the handle 105. Even in a state where the rod holder C1 is caused to hold a long article such as a rod or a net, it becomes possible to easily grip the handle 105. This enhances convenience.

In the article holding device 100 of the present embodiment, each of the holders 101 and 102 is provided with the annular hook 170. Therefore, it is possible to attach a cord-like article such as a leash to the hook 170, and convenience is improved. For example, by attaching a leash attached to an article held by the holding portions C1 and C2 to the hook 170, it is possible to prevent an article from dropping to water.

The watercraft body 2 of the PWC 1 of the present embodiment is provided with the pair of holder support portions 40 and 40 that can support the first holder 101 and the second holder 102, respectively. Therefore, each of the two holders 101 and 102 can be attached to the watercraft body 2.

In the PWC 1 of the present embodiment, the two holder support portions 40 and 40 are provided at positions separated from each other regarding the left-right direction of the watercraft body 2. Therefore, the article held by the holding portions C1 and C2 of the first holder 101 and the article held by the holding portions C1 and C2 of the second holder 102 can be easily arranged at different positions in the left-right direction of the watercraft body 2.

In particular, in the PWC 1 of the present embodiment, the holder support portions 40 are fixed to the left and right sides of the rear frame 30 provided on the rear deck 9 rearward of the seat 6 and accommodating the cooler 300 inside thereof. Therefore, when each of the holders 101 and 102 is engaged to the holder support portion 40, it is possible to avoid each of the holders 101 and 102 from obstructing access to the cooler 300 from the front, that is, from the seat 6. That is, it is possible to make it easier to access the cooler 300 while engaging each of the holders 101 and 102 to the holder support portion 40.

In the PWC 1 of the present embodiment, in the rear frame 30, the fourth pipe 35 on the rear side and the first reinforcing pipe 37 that connect the rear end parts of the fifth pipes 36 and 36 on which the holder support portions 40 and 40 are supported are arranged above the reboarding step 10. Thus, the user can use the fourth pipe 35 on the rear side or/and the first reinforcing pipe 37 as a handrail when going up from water to the deck 4 using the reboarding step 10. That is, in the PWC 1 of the present embodiment, the rear frame 30 including the fifth pipes 36 and 36, the fourth pipe 35 on the rear side, and the first reinforcing pipe 37 can be used as a member for engaging each of the holders 101 and 102 and also as a handrail, and the structure can be simplified as compared with a case where a member for engagement and a handrail are individually provided.

Modification

In the above embodiment, the case where the holding portion forming portions 160 and 260 are separated from the rear surface portions 110 and 210 and fixed to the rear surface portions 110 and 210 in the holders 101 and 102, respectively, has been described, but these holding portion forming portions 160 and 260 and the rear surface portions 110 and 210 may be integrally formed. However, if these are formed separately, it is possible to achieve different types of article holding devices by using the common rear surface portions 110 and 210 with respect to different types of holding and forming portions. Thus, manufacturing of the article holding device can be made easy when manufacturing a plurality of types of article holding devices, changing the shape of the holding and forming portion, and the like.

In the above embodiment, the case where each of the holders 101 and 102 is provided with both the rod holder C1 and the small item case C2 has been described, but one of the rod holder C1 and the small item case C2 can be omitted.

In the above embodiment, the case where the rear frame 30 is provided with the first reinforcing pipe 37 and the second reinforcing pipes 38 and 38 has been described, but these reinforcing pipes 37, 38, and 38 may be omitted.

In the above embodiment, the case where the PWC 1 and the article holding device 100 are mainly used for fishing has been described, but the use purpose of the PWC 1 and the article holding device 100 is not limited to fishing.

In the above embodiment, the case where the watercraft body 2 is provided with the pair of holder support portions 40 capable of engaging the respective holders 101 and 102 has been described, but the number of the holder support portions 40 provided to the watercraft body 2 may be one.

In the above embodiment, the straddle-type personal watercraft (PWC 1) including the seat 6 has been exemplified as an example of the personal watercraft according to the present disclosure, but the personal watercraft may be of a stand-up type on which the operator rides in a standing position.

In the above embodiment, the case where each of the holders 101 and 102 is detachably engaged to the PWC 1 has been described, but each of the holders 101 and 102 may be detachably engaged to a vehicle other than the PWC 1.

Summary

The embodiment and modifications thereof include the following disclosure.

An article holding device for a watercraft body according to one aspect of the present disclosure includes: a pair of holders each having a holding portion capable of holding an article, in which each of the holders includes a lock portion detachably engaged to the watercraft body, and a coupling mechanism removably coupling both of the holders removed from the watercraft body.

According to the present disclosure, it is possible to reduce time and effort required for loading and unloading articles onto and from a watercraft body, and to facilitate transportation of a plurality of articles.

Preferably, the holder includes an operation portion that switches the lock portion between an engaged state of being engaged to the watercraft body and a detached state of being detached from the watercraft body.

In this aspect, the article holding device can be attached to and removed from the watercraft body by operation of the operation portion.

Preferably, the holder includes a handle forming portion that forms a handle that is grippable by a user in a state where a pair of the holders are coupled to each other.

According to this aspect, the two holders and the article held by the holders are easily transported.

Preferably, the coupling mechanism couples both the holders in a posture where the lock portions for the holders are separated from each other regarding a coupling direction of both the holders.

According to this aspect, it is possible to prevent the lock portions from interfering with each other when the holder is coupled, and it is possible to suppress damage to the lock portions.

Preferably, the operation portion is arranged at a position recessed relative to a part around the operation portion.

According to this aspect, it is possible to prevent a user's hand or an article from unexpectedly coming into contact with the operation portion. This makes it possible to prevent the holder from being unintentionally detached from the watercraft body.

Preferably, the operation portion is arranged at a position recessed relative to the holding portion.

According to this aspect, it is possible to prevent an unexpected operation of the operation portion using the holding portion.

Preferably, the holder includes a bottom surface extending in a predetermined direction, and the coupling mechanism couples both the holders in a posture where bottom surfaces of both the holders extend along a same plane and extend in a direction orthogonal to a coupling direction at positions separated from each other in the coupling direction of both the holders.

According to this aspect, it becomes possible to cause each holder to stand by itself in the holder coupled state, and convenience is improved.

Preferably, the holder includes a supported portion supported by the watercraft body at a position where the lock portion is engaged to the watercraft body.

According to this aspect, it is possible to lock the lock portion to the watercraft body in a state where the supported portion is supported by the watercraft body and the holder is stable, and the engaging operation becomes easy.

Preferably, the coupling mechanism couples both the holders in a posture in which the holding portions of both the holders are separated from each other in a coupling direction of both the holders across the handle.

According to this aspect, since the holding portion and the article held by this are arranged around the handle in a well-balanced manner, it is possible to stabilize the posture of the article holding device in a state where the user grips the handle.

Preferably, the holding portion includes a tubular portion extending in an up-down direction and opening at least upward.

According to this aspect, it is possible to cause the tubular portion to hold a long article, and the article can be easily transported.

Preferably, at least a part of the holding portion is arranged below the handle forming portion.

According to this aspect, it is possible to achieve the holding portion by using the space below the handle forming portion.

Preferably, the holding portion includes a first holding portion arranged below the handle forming portion and a pair of second holding portions arranged at positions separated from each other in a horizontal direction across the handle.

According to this aspect, it is possible to achieve the holding portion by effectively using the periphery of the handle.

Preferably, the holding portion is capable of holding a fishing tool.

According to this aspect, convenience can be enhanced particularly when the personal watercraft is used for fishing.

Preferably, the holder includes an annular hook.

According to this aspect, it is possible to attach a cord-like member such as the leash to the holder via the hook, and the convenience is improved.

Preferably, the holding portion includes a small item case extending in an up-down direction, opening upward, and closing downward.

According to this aspect, various articles can be accommodated in the holding portion, and convenience is improved.

A personal watercraft according to another aspect of the present invention includes: the article holding device; and a watercraft body, in which the watercraft body includes a holder support portion that has a lock engaging portion to which the lock portion is detachably engaged, the holder support portion being capable of supporting the holder.

According to this aspect, by locking the lock portion to an engaged portion, it is possible to cause the holder support portion and the watercraft body to easily support the holder.

Preferably, the watercraft body includes a pair of the holder support portions capable of respectively supporting a pair of the holders having been decoupled.

According to this aspect, it is possible to cause the holder support portion and eventually the watercraft body to support the two holders, respectively.

Preferably, a pair of the holder support portions are provided at positions separated from each other regarding a left-right direction of the watercraft body.

According to this aspect, it is possible to arrange various articles at positions separated from each other in the left-right direction of the watercraft body in a state of being held by the holding portion.

Preferably, the watercraft body includes a reboarding step, a pair of left and right frame members respectively provided at a rear part of the watercraft body in a state of being separated from each other regarding the left-right direction of the watercraft body, and extending in a front-rear direction of the watercraft body, and a rear frame member connecting rear end parts of the frame members to each other, in which the rear frame member is arranged above the reboarding step, and the holder support portion is supported by the frame member.

In this aspect, the frame member can be used as a handrail when the user goes up from water to the watercraft body using the reboarding step, in addition to the holder support portion and eventually the member for supporting the holder.

The invention claimed is:

1. An article holding device for a watercraft body, the article holding device comprising:

a pair of holders, including a holding portion capable of holding an article; and a lock portion detachably engaged to the watercraft body, wherein each of the holders constitutes a coupling mechanism removably coupling both of the holders removed from the watercraft body, the coupling mechanism includes a first holder coupling portion located at a first holder constituting one of the pair of holders, and a second holder coupling portion located at a second holder constituting the other of the pair of holders, and in a holder coupled state where the first holder and the second holder are coupled to each other, the first holder coupling portion and the second holder coupling portion are in contact with each other in an arrangement direction in which the first holder and the second holder are arranged.

2. The article holding device according to claim 1, wherein each of the holders includes an operation portion that switches the lock portion between an engaged state of being engaged to the watercraft body and a detached state of being detached from the watercraft body.

3. An article holding device for a watercraft body, the article holding device comprising:

a pair of holders, each of the holders including:

a holding portion capable of holding an article;

a lock portion detachably engaged to the watercraft body, each of the holders constituting a coupling mechanism removably coupling both of the holders removed from the watercraft body; and a handle forming portion that forms a handle that is grippable by a user in a holder coupled state where the pair of holders are coupled to each other, wherein in the holder coupled state, the handle forming portion included in a first holder constituting one of the pair of holders and the handle forming portion included in a second holder constituting the other of the pair of holders are in contact with each other in an arrangement direction in which the first holder and the second holder are arranged.

4. The article holding device according to claim 1, wherein the coupling mechanism couples both the holders in a posture where the lock portions for the holders are separated from each other regarding a coupling direction of both the holders.

5. The article holding device according to claim 2, wherein each operation portion is arranged at a position recessed relative to a part around the operation portion.

6. The article holding device according to claim 2, wherein each operation portion is arranged at a position recessed relative to a respective one of the holding portions.

7. The article holding device according to claim 1, wherein each of the holders includes a bottom surface extending in a predetermined direction, and the coupling mechanism couples both the holders in a posture where bottom surfaces of both the holders extend along a same plane and extend in a direction orthogonal to a coupling direction at positions separated from each other in the coupling direction of both the holders.

8. The article holding device according to claim 1, wherein each of the holders includes a supported portion supported by the watercraft body at a position where the lock portion is engaged to the watercraft body.

9. The article holding device according to claim 3, wherein the coupling mechanism couples both the holders in a posture in which the holding portions of both the holders are separated from each other in a coupling direction of both the holders across the handle.

10. The article holding device according to claim 9, wherein each holding portion includes a tubular portion extending in an up-down direction and opening at least upward.

11. The article holding device according to claim 9, wherein at least a part of the holding portions are arranged below the handle forming portion.

12. The article holding device according to claim 11, wherein each holding portion includes a first holding portion arranged below the handle forming portion and a pair of second holding portions arranged at positions separated from each other in a horizontal direction across the handle.

13. The article holding device according to claim 1, wherein each holding portion is capable of holding a fishing tool.

14. The article holding device according to claim 1, wherein each holder includes an annular hook.

15. An article holding device for a watercraft body, the article holding device comprising:

a pair of holders including:

a holding portion capable of holding an article, a lock portion detachably engaged to the watercraft body, and each of the holders constitutes a coupling mechanism removably coupling both of the holders removed from the watercraft body; and an item case extending in an up-down direction, opening upward, and closing downward.

16. A personal watercraft comprising:

the article holding device according to claim 1; and a watercraft body, wherein the watercraft body includes a holder support portion that has a lock engaging portion to which the lock portion is detachably engaged, the holder support portion being capable of supporting the holder.

17. The personal watercraft according to claim 16, wherein the watercraft body includes a pair of the holder support portions capable of respectively supporting a pair of the holders having been decoupled.

18. The personal watercraft according to claim 16, wherein a pair of the holder support portions are provided at positions separated from each other regarding a left-right direction of the watercraft body.

19. The personal watercraft according to claim 16, wherein the watercraft body includes a reboarding step, a pair of left and right frame members respectively provided at a rear part of the watercraft body in a state of being separated from each other regarding the left-right direction of the watercraft body, and extending in a front-rear direction of the watercraft body, and a rear frame member connecting rear end parts of the frame members to each other, the rear frame member is arranged above the reboarding step, and the holder support portion is supported by the frame member.

20. An article holding device comprising a pair of holders each having a holding portion capable of holding an article, wherein each of the holders includes a lock portion detachably engaged to a vehicle, and constitutes a coupling mechanism removably coupling both of the holders removed from the vehicle, the coupling mechanism includes a first holder coupling portion located at a first holder constituting one of the pair of holders, and a second holder coupling portion located at a second holder constituting the other of the pair of holders, and, in a holder coupled state where the first holder and the second holder are coupled to each other, the first holder coupling portion and the second holder coupling portion are in contact with each other in an arrangement direction in which the first holder and the second holder are arranged.

* * * * *